United States Patent [19]

Mimura et al.

[11] Patent Number: 4,996,424

[45] Date of Patent: Feb. 26, 1991

[54] ATMOSPHERIC PRESSURE IONIZATION MASS SPECTROMETER

[75] Inventors: Tadao Mimura, Katsuta; Yoshiaki Kato, Mito, both of Japan

[73] Assignee: Hitachi, Ltd., Tokyo, Japan

[21] Appl. No.: 531,247

[22] Filed: May 3, 1990

[51] Int. Cl.[5] ..... H01J 49/04

[52] U.S. Cl. ..... 250/288; 250/281

[58] Field of Search ..... 250/288, 281, 282

[56] References Cited

U.S. PATENT DOCUMENTS 3,999,065 12/1976 Briggs ..... 250/288

FOREIGN PATENT DOCUMENTS 58-43692 9/1983 Japan .

OTHER PUBLICATIONS

Carroll et al., Analytical Chemistry, vol. 47, No. 14, Dec. 1975, pp. 2369–2373.

Covey et al., Analytical Chemistry, vol. 58, No. 14, Dec. 1986, pp. 1451A–1461 A.

Vestal et al., Analytical Chemistry, vol. 57, No. 12, Oct. 1985, pp. 2373–2378.

*Primary Examiner*—Jack I. Berman

*Attorney, Agent, or Firm*—Antonelli, Terry, Stout & Kraus

[57] ABSTRACT

An atmospheric pressure ionization mass spectrometer has an interface by which the mass spectrometer is coupled on-line to a liquid chromatograph. This interface comprises an atomization unit which heats and atomizes a sample carried out by a mobile phase from the liquid chromatograph. The atomization unit includes a sample introducing pipe having therein a plurality of thin passages which extend along an axis of the pipe and into which the sample is introduced for atomization.

8 Claims, 3 Drawing Sheets

ATMOSPHERIC PRESSURE IONIZATION MASS SPECTROMETER

BACKGROUND OF THE INVENTION

The present invention relates to an atmospheric pressure ionization mass spectrometer with an ionization function which utilizes molecular reaction. More particularly, the present invention pertains to an atmospheric pressure ionization mass spectrometer provided with an interface used for on-line coupling of the mass spectrometer to a liquid chromatograph.

It is known to employ an atmospheric pressure ionization mass spectrometer which is coupled on-line to a liquid chromatograph (hereinafter referred to as an "LC") to achieve improvement of analysis performance. An on-line coupled liquid chromatograph/mass spectrometer (hereinafter referred to as an "LC/API mass spectrometer"), which utilizes atmospheric pressure ionization (hereinafter referred to as an "API"), has advantages that cannot be obtained by a conventional on-line coupled gas chromatograph/mass spectrometer (hereinafter referred as an "GC/EI mass spectrometer"), which utilizes electron impact ionization. For example, since the LC/AIP mass spectrometer employs the ionization means which imparts less impact, decomposition of a sample to be ionized is less, thus facilitating observation of molecular ions.

Techniques of on-line coupling of an LC to a mass spectrometer are disclosed in, for example, Japanese Patent Examined Publication No. 58-43692 filed by this assignee and in ANALYTICAL CHEMISTRY, Vol. 58, No. 14 (December 1986), pp, 1451A–1461A.

On-line coupling of the LC to the mass spectrometer requires processing of the liquid output from the LC in a form suitable for spectrometric analysis by the mass spectrometer. Some processing techniques are introduced in the aforementioned text ANALYTICAL CHEMISTRY. The typical interface is an atomization unit for atomizing the sample and the mobile phase which flow out of the LC. The sample and the mobile phase which flow out of the LC are introduced into this atomization unit where they are heated and, thereby, the sample is reduced to molecular particles. In the mass spectrometer coupled on-line to the LC, the sample is first ionized by corona discharge in an ionization chamber, and mass spectrometric analysis is then conducted on the ions.

The conventional atomization units, which are described in, for example, ANALYTICAL CHEMISTRY, Vol. 57, No. 12 (Oct./1985), pp. 2374–2375, employ a thin tube having an inner diameter of 0.1 mm as a sample introducing pipe. This sample introducing pipe is formed integrally with a heater block which is heated to atomize the sample and the mobile phase. In this configuration, however, the temperature of the heater block and the flow rate of the sample and the mobile phase delicately affect atomization thereof, and it is thus very difficult to set the temperature of the heater block adequately, which is required to obtain stable fine particles.

In the LC/API mass spectrometer, atomization of the sample and the mobile phase to stable and minute particles is essential for achieving mass spectrometric analysis at a high sensitivity.

SUMMARY OF THE INVENTION

The present invention has an object of providing an atmospheric pressure ionization mass spectrometer which is capable of atomizing a sample and a mobile phase from a liquid chromatograph into stable and fine particles.

Another object of the invention is to provide an atmospheric pressure ionization mass spectrometer having an interface for on-line coupling to a liquid chromatograph, which assures mass spectrometry at a high sensitivity and has a simple structure.

The above-described objects of the invention are achieved by the provision of the structure in which a sample introducing pipe of an atomizing section in the atmospheric pressure ionization mass spectrometer has a plurality of thin holes which extend along an axis of the pipe and into which the sample is introduced for atomization.

Preferably, the plurality of holes may be disposed in a circular or radial form on the cross-section of the sample introducing pipe. Each hole may have a diameter ranging from 0.01 mm to 0.05 mm.

Further, the holes may be defined by a thin pipe or plate, which serves as an outer wall for the pipe, and a plurality of rod members disposed in close contact with each other within the thin pipe or plate. Alternatively, the holes may be defined by a thin pipe and a porous metal or sintered body inserted in the thin pipe.

In the above-described structure according to the invention, a contact area of the sample and the mobile phase with the inner surface of the sample introducing pipe can be increased due to the plurality of holes, thus increasing the amount of heat applied to the sample and the mobile phase. Furthermore, the temperature difference between the inner surface of each of the holes and the center thereof can be reduced, enabling the sample and the mobile phase to be atomized into a stable and minute spray.

According to another aspect of the invention, an atmospheric pressure ionization mass spectrometer on-line coupled to a liquid chromatograph includes means for heating and atomizing a mobile phase and a sample which flow out of the liquid chromatograph. This heating and atomizing means contains a plurality of passages through which the mobile phase and the sample are led. The plurality of flow passages are disposed such that they ensure uniform transfer of heat to the mobile phase and the sample.

BRIEF DESCRIPTION OF THE DRAWINGS

Further objects and advantages of the invention will be apparent from the description which will be made below with reference to the accompanying drawings wherein.

DESCRIPTION OF THE PREFERRED EMBODIMENTS

Figure 1:
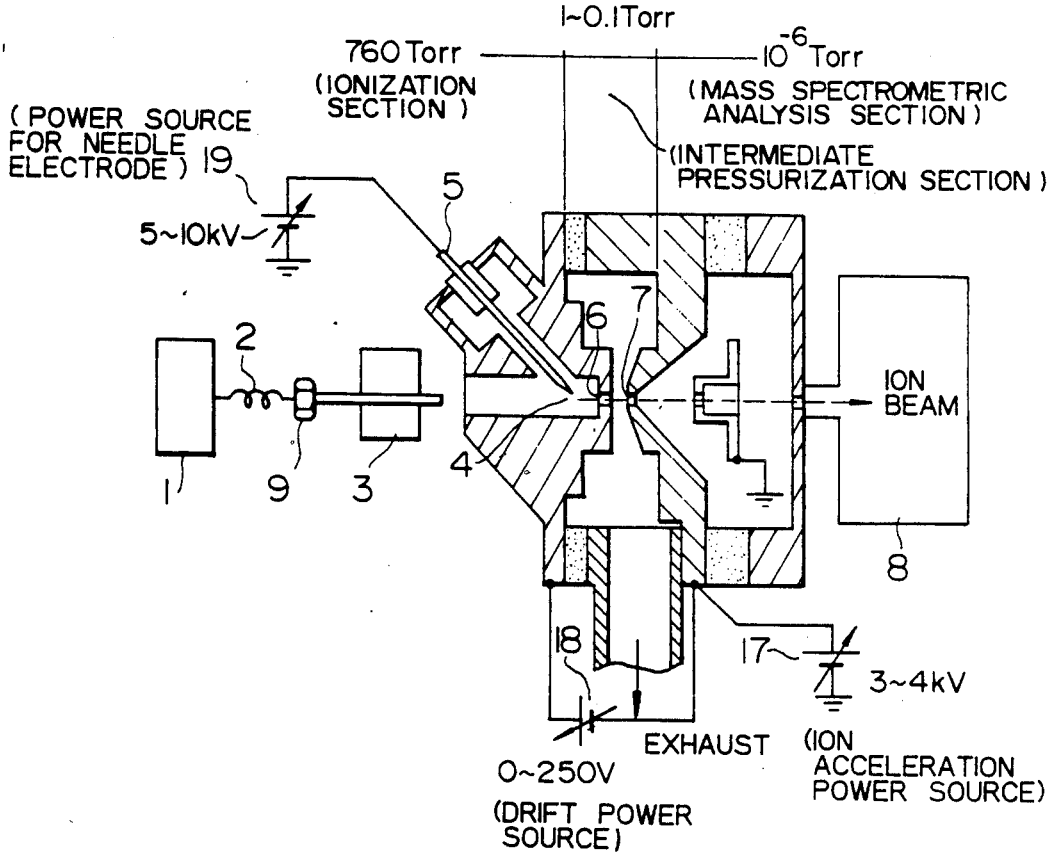
FIG. 1 is a cross-sectional view of an atmospheric pressure ionization mass spectrometer according to an embodiment of the invention.

The invention will now be described in detail with reference to the accompanying drawings FIG. 1 shows a schematic view of an atmospheric pressure ionization mass spectrometer according to an embodiment of the invention. The atmospheric pressure ionization mass spectrometer includes an atomization section 3, an ionization section, an intermediate pressurization section and a mass spectrometric analysis section 8, which are coupled to the atomization section 3. The ionization section has an ionization chamber 4 which is located adjacent to the atomization section 3. A needle electrode 5, which is electrically connected to a power source 19, is provided in the ionization chamber 4. The ionization chamber 4 communicates with the intermediate pressurization section which in turn communicates with the mass spectrometric analysis section 8. A drift power source 18 and an ion acceleration power source 17 are connected to the mass spectrometer.

In FIG. 1, a reference numeral 1 denotes a liquid chromatograph (hereinafter referred to as an "LC") connected to the mass spectrometer. The LC 1 is connected to the atomization section 3 of the mass spectrometer by way of a Teflon pipe 2.

The sample and the mobile phase which flow out of the LC 1 are introduced through the Teflon pipe 2 to the atomization section 3 where they are heated and thereby atomized to molecular particles. The molecular particles of sample and mobile phase are fed to the ionization chamber 4 where they are ionized by the corona discharge generated by the needle electrode 5. In the ionization chamber 4, the ionized molecules of the mobile phase react with the molecules of the sample, and thereby give protons to the molecules of the sample which are not yet ionized to ionize the same. In this way, the molecules of the sample are ionized mildly, and substantially all the molecules of the sample are ionized. The ionized molecules of the sample are fed to the intermediate pressurization section through a first thin hole 6, and then fed through a second thin hole 7 to the mass spectrometric analysis section 8 where mass spectrometric analysis of the sample is conducted.

The structure of the LC 1 and that of the atmospheric pressure ionization mass spectrometer except the atomization section 3 may be the same as those of the conventional LC and mass spectrometer, and detailed description thereof will be omitted.

Figure 2:
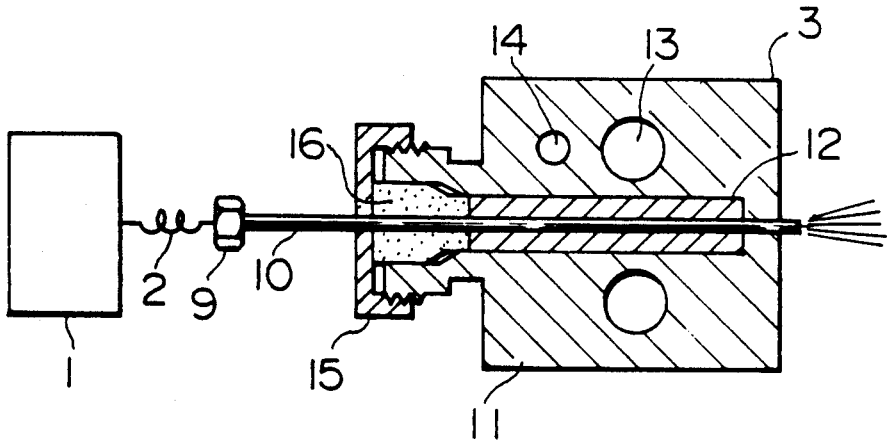
FIG. 2 is an enlarged cross-sectional view of a sample introducing pipe of the mass spectrometer shown in FIG. 1.

FIG. 2 shows the structure from the LC 1 to the atomization section 3. The atomization section 3 includes a sample introducing pipe 10 and a heater block 11 with a hole formed therein to accommodate the pipe 10. As shown in FIG. 2, the Teflon pipe 2, through which the sample and the mobile phase flowing out of the LC 1 are introduced to the atomization section 3, is connected to the sample introducing pipe 10 through a joint 9 which has swaged locking screw. The sample introducing pipe 10 is accommodated into the hole in the heater block 11 through spacers 12 and 16 and is fixed thereto by a locking screw 15. The spacer 12 is made of a material which has a high coefficient of heat conductivity so as to ensure excellent heat conduction between the heater block 11 and the sample introducing pipe 10. A heater 13 for heating the sample introducing pipe 10 and a temperature detecting element 14 for detecting the temperature are provided in the heater block 11 to heat the sample and the mobile phase to an arbitrary and fixed temperature.

The sample introducing pipe 10 is formed such that it defines a plurality of thin flow passages or paths which extend over the entire length thereof. In this embodiment, the sample introducing pipe 10 is made of a ceramic and has an outer diameter of 1.6 mm and a length of 150 mm. The sample introducing pipe 10 has 6 holes which are formed therein radially as viewed on the cross-section of the pipe shown in FIG. 3. Each of the holes, having a diameter of 0.04 mm, serves as a flow passage. The arrangement of the holes shown in FIG. 3 minimizes variations in the heat applied to each hole from the heater block 11.

In the above-described structure, the sum of the cross-sectional areas of the holes decreases 0.96 times that of the single hole having a diameter of 0.1 mm formed in the conventional sample introducing pipe. However, the sum of the surface areas of the inner walls of the holes increases 2.4 times that of the hole formed in the conventional sample introducing pipe, and the distance from the inner wall of each hole to the center thereof decreases 0.4 times, thus assuring excellent heat conduction. In fact, as a result of an experiment where atomization was actually conducted by using the above structure at a flow rate of 0.8 to 1.0 cc/min, stable atomization was obtained at a heater block temperature of 300° to 350° C. This temperature range is lower than the temperature range of 380° to 400° C. in the conventional mass spectrometer. Furthermore, the sample and the mobile phase are reduced to finer molecular particles. These enable the sensitivity of the atmospheric pressure ionization mass spectrometer to be improved 5 to 10 times that of the conventional one.

The ceramic employed as the material of the sample introducing pipe in this embodiment chemically activates the sample or the like, and is therefore not adequate to all types of samples. However, with the present technology, ceramics are the only materials that permit formation of holes having a diameter of 0.01 to 0.05 mm over the length of 100 to 150 mm. Accordingly, progress of the technology which enables manufacture of a more effective sample introducing pipe from gold (Au), which is the most chemically stable substance, is anticipated.

Figure 3:
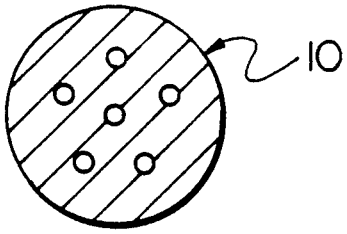
FIG. 3 is a cross-section of the sample introducing pipe shown in FIG. 2.
Figure 4:
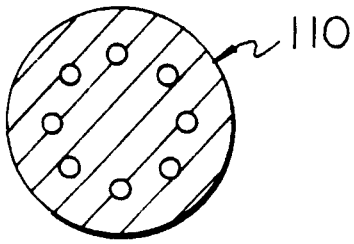
FIG. 4 is a cross-section of a modification of the sample introducing pipe shown in FIG. 3.

FIG. 4 shows a modification of the sample introducing pipe. A sample introducing pipe 110 shown in FIG. 4 has the same structure as that of the sample introducing pipe shown in FIG. 3 except for the arrangement of thin holes which serve as flow passages. Whereas the six holes are disposed radially in the sample introducing pipe shown in FIG. 3, a plurality of holes are disposed in a circular form in the sample introducing pipe shown in FIG. 4. The arrangement of the holes shown in FIG. 4 also ensures uniform conduction of heat from the heater block 11 to the sample or the mobile phase.

Figure 5:
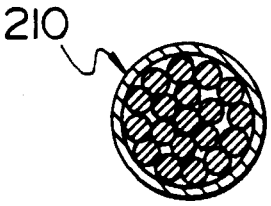
FIG. 5 is a cross-section of another modification of the sample introducing pipe shown in FIG. 3.
Figure 6:
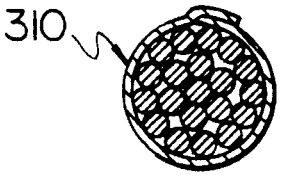
FIGS. 6 and 7 are cross-sections of still other modifications of the sample introducing pipe shown in FIG. 3.

Turning to FIGS. 5 and 6 which respectively show other modifications of the sample introducing pipe, sample introducing pipes 210 and 310 are manufactured by a different method from that in which the sample introducing pipes shown in FIGS. 3 and 4 are manufactured. The sample introducing pipe 210 shown in FIG. 5 includes a thin pipe which is made of, for example, stainless steel to serve as an outer wall of the sample introducing pipe 210, and a plurality of thin rods which are made of, for example, stainless steel and which are accommodated in the pipe. As seen in FIG. 5, spaces are left between the rods, and these spaces serve as the flow passages. The outer wall of the sample introducing pipe 310 shown in FIG. 6 is formed by a thin plate which is made of, for example, stainless steel and which is wound around a plurality of thin rods. Although the sample introducing pipes shown in FIGS. 5 and 6 are easily manufactured, they make desired arrangement of the plurality of flow passages difficult, unlike those shown in FIGS. 3 and 4. Hence, in terms of the uniform atomization, the sample introducing pipes shown in Figs. 3 and 4 are more effective.

Figure 7:
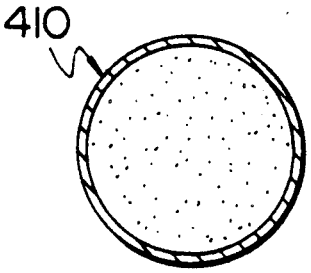

FIG. 7 shows another modification of the sample introducing pipe. A sample introducing pipe 410 shown in FIG. 7 includes a thin pipe which is made of, for example, stainless steel to serve as an outer wall, and a porous metal or sintered body inserted in the pipe. In this modification, the size of thin holes is changed by changing the size of the particles of the metal or sintered body, thus enabling the number of holes to be increased. Although more fine particles of the sample and the mobile phase can be obtained by this sample introducing pipe, all of their particles do not flow out of the forward end of the pipe straight ahead, necessitating that the atomization section 3 be designed such that all the particles are led to the ionization chamber 4.

As will be understood from the foregoing description, according to the invention, since the sample and the mobile phase can be converted to stable and minute particles, the sensitivity of the mass spectrometric analysis can be improved 5 to 50 times as compared with that of the conventional mass spectrometer. This simplifies adjustment of the sensitivity and the operation of the AC/API mass spectrometer.

Having described the invention as related to the embodiments shown in the accompanying drawings, it should be appreciated that the invention be not limited solely to the specific forms of the embodiments but rather be constructed broadly within its spirit and scope as set out in the appended claims.

What is claimed is:

1. An atmospheric pressure ionization mass spectrometer, comprising:

an atomization section for heating and atomizing a sample carried by a mobile phase;

an ionization section for ionizing the atomized sample; and a mass spectrometric analysis section for determining a mass of the ionized sample; and said atomization section including a sample introducing pipe means provided therein with a plurality of thin holes for introduction of the sample for atomization, said thin holes extending along an axis of said sample introducing pipe means.

2. The mass spectrometer according to claim 1, wherein said holes are disposed in a circular form on a cross-section of said sample introducing pipe.

3. The mass spectrometer according to claim 1, wherein said holes are disposed in a radial manner on a cross-section of said sample introducing pipe.

4. The mass spectrometer according to claim 2, wherein each of said holes has a diameter from 0.01 mm to 0.05 mm.

5. The mass spectrometer according to claim 3, wherein each of said holes has a diameter from 0.01 mm to 0.05 mm.

6. An atmospheric pressure ionization mass spectrometer according to claim 1, wherein said sample introducing pipe means includes a pipe which serves as an outer wall and a plurality of rod members accommodated within said pipe in close contact with each other so as to define said holes therebetween.

7. The mass spectrometer according to claim 1, wherein said sample introducing pipe means includes a plurality of rod members disposed in close contact with each other so as to define said holes therebetween, and a plate member wound around said rod members to form an outer wall.

8. An atmospheric pressure ionization mass spectrometer coupled on-line to a liquid chromatograph, including means for heating and atomizing a mobile phase and a sample which flow out of the liquid chromatograph, and said heating and atomizing means has a plurality of passages which are disposed such that they ensure uniform transfer of heat to the mobile phase and the sample and into which the mobile phase and the sample are introduced.

* * * * *